US007861868B2

(12) United States Patent
Blaha et al.

(10) Patent No.: US 7,861,868 B2
(45) Date of Patent: Jan. 4, 2011

(54) CHIP SORTING AND STACKING DEVICES

(75) Inventors: Ernst Blaha, Tullnerback (AT); Peter Krenn, Neufeld (AT)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

(21) Appl. No.: 11/932,691

(22) Filed: Oct. 31, 2007

(65) Prior Publication Data

US 2008/0053876 A1 Mar. 6, 2008

Related U.S. Application Data

(60) Division of application No. 11/004,006, filed on Dec. 3, 2004, which is a continuation of application No. PCT/AT03/00149, filed on May 26, 2003.

(51) Int. Cl.
*B07C 5/00* (2006.01)
*B07C 5/342* (2006.01)
*G07D 1/00* (2006.01)

(52) U.S. Cl. ..... 209/652; 209/578; 209/580; 209/651; 453/6; 453/10; 453/26; 453/33; 453/44

(58) Field of Classification Search ..... 209/576, 209/580, 651, 652; 453/6, 10, 12, 13, 15, 453/19–26, 33, 37, 38, 43, 44, 48
See application file for complete search history.

(56) References Cited

U.S. PATENT DOCUMENTS 2,020,293 A 11/1935 Adelstein
3,143,118 A * 8/1964 Haines ..... 453/13
3,435,833 A * 4/1969 Tanaka ..... 453/21
3,680,566 A * 8/1972 Tanaka et al. ..... 453/4
3,766,452 A 10/1973 Burpee et al.
3,771,538 A 11/1973 Reis
3,827,582 A 8/1974 Lederer (Continued)

FOREIGN PATENT DOCUMENTS

AT 006405 10/2003

(Continued)

OTHER PUBLICATIONS

International Search Report dated Mar. 6, 2008, for International Application No. PCT/EP2007/008873 (3 pages).

*Primary Examiner*—Patrick Mackey
*Assistant Examiner*—Terrell H Matthews
(74) *Attorney, Agent, or Firm*—TraskBritt

(57) ABSTRACT

Chip sorting devices include a rotatable disc having a plurality of wells for receiving chips therein, a plurality of channels for holding stacks of chips, at least one ejector for ejecting chips from the wells of the disc into the channels, and at least one removal lever associated with at least one of the channels. The removal lever has an arm configured to extend adjacent at least a portion of a stack of chips when the stack of chips is in a channel. Other chip sorting devices include a plurality of wells for receiving chips therein, a plurality of channels for holding stacks of chips, at least one ejector for ejecting chips from the wells of the disc into the channels, and at least one spring member configured to bias the ejector to a position.

13 Claims, 4 Drawing Sheets

U.S. PATENT DOCUMENTS

| | | | | |
|---|---|---|---|---|
| 4,157,139 | A | 6/1979 | Bjork | |
| 4,161,381 | A | 7/1979 | Sciortino | |
| 4,209,960 | A | 7/1980 | Deutschländer et al. | |
| 4,275,751 | A | 6/1981 | Bergman | |
| 4,360,034 | A | 11/1982 | Davila et al. | |
| 4,531,531 | A | 7/1985 | Johnson et al. | |
| 4,543,969 | A | 10/1985 | Rasmussen | |
| 4,607,649 | A | 8/1986 | Taipale et al. | |
| 4,681,128 | A | 7/1987 | Ristvedt et al. | |
| 4,731,043 | A | 3/1988 | Ristvedt et al. | |
| 4,775,354 | A | 10/1988 | Rasmussen et al. | |
| 4,863,414 | A | 9/1989 | Ristvedt et al. | |
| 4,966,570 | A | 10/1990 | Ristvedt et al. | |
| 5,011,456 | A * | 4/1991 | Kobayashi et al. | 453/32 |
| 5,042,810 | A | 8/1991 | Williams | |
| 5,141,443 | A | 8/1992 | Rasmussen et al. | |
| 5,166,502 | A | 11/1992 | Rendleman et al. | |
| 5,207,612 | A | 5/1993 | Wollaston | |
| 5,406,264 | A | 4/1995 | Plonsky et al. | |
| 5,460,295 | A | 10/1995 | Law | |
| 5,531,331 | A * | 7/1996 | Barnett | 209/580 |
| 5,624,308 | A | 4/1997 | Rumbach | |
| 5,651,548 | A | 7/1997 | French et al. | |
| 5,735,742 | A | 4/1998 | French | |
| 5,755,618 | A | 5/1998 | Mothwurf | |
| 5,757,876 | A | 5/1998 | Dam et al. | |
| 5,770,533 | A | 6/1998 | Franchi | |
| 5,781,647 | A | 7/1998 | Fishbine et al. | |
| 5,836,583 | A | 11/1998 | Towers | |
| 5,895,321 | A | 4/1999 | Gassies et al. | |
| 5,931,732 | A | 8/1999 | Abe et al. | |
| 5,933,244 | A | 8/1999 | Kiritchenko | |
| 5,957,262 | A | 9/1999 | Molbak et al. | |
| 5,957,776 | A | 9/1999 | Hochne | |
| 6,021,949 | A | 2/2000 | Boiron | |
| 6,075,217 | A | 6/2000 | Kiritchenko | |
| 6,080,056 | A | 6/2000 | Karlsson | |
| 6,168,001 | B1 | 1/2001 | Davis | |
| 6,186,895 | B1 | 2/2001 | Oliver | |
| 6,260,757 | B1 | 7/2001 | Strisower | |
| 6,264,109 | B1 | 7/2001 | Chapet et al. | |
| 6,283,856 | B1 | 9/2001 | Mothwurf | |
| 6,296,190 | B1 | 10/2001 | Rendleman | |
| 6,313,871 | B1 | 11/2001 | Schubert | |
| 6,381,294 | B1 * | 4/2002 | Britton | 377/7 |
| 6,464,584 | B2 | 10/2002 | Oliver | |
| 6,506,115 | B1 | 1/2003 | Mothwurf | |
| 6,532,297 | B1 | 3/2003 | Lindquist | |
| 6,567,159 | B1 | 5/2003 | Corech | |
| 6,572,474 | B2 | 6/2003 | Rudd | |
| 6,581,747 | B1 | 6/2003 | Charlier et al. | |
| 6,629,591 | B1 | 10/2003 | Griswold et al. | |
| 6,733,388 | B2 | 5/2004 | Mothwurf | |
| 6,753,830 | B2 | 6/2004 | Gelbman | |
| 6,772,870 | B2 * | 8/2004 | Sugai et al. | 194/217 |
| 6,976,589 | B2 * | 12/2005 | De Raedt et al. | 209/552 |
| 7,014,554 | B1 | 3/2006 | Fletcher et al. | |
| 2004/0149539 | A1 | 8/2004 | De Raedt et al. | |
| 2005/0155838 | A1 | 7/2005 | Raedt et al. | |
| 2005/0280212 | A1 * | 12/2005 | Blaha et al. | 273/292 |
| 2007/0212996 | A1 * | 9/2007 | Ryou | 453/13 |

FOREIGN PATENT DOCUMENTS

| | | |
|---|---|---|
| AT | 006 546 | 12/2003 |
| CA | 2090073 | 8/1994 |
| CA | 2229054 | 8/1996 |
| CA | 2229053 | 10/1996 |
| DE | 4240886 | 7/1994 |
| EP | 0424355 | 11/1994 |
| EP | 0631260 | 12/1994 |
| EP | 0757582 | 2/1997 |
| EP | 0806020 | 12/1998 |
| EP | 1080348 | 8/2002 |
| EP | 0823041 | 9/2002 |
| EP | 0950989 | 9/2003 |
| EP | 1050024 | 3/2004 |
| FR | 2 749 093 | 7/1998 |
| FR | 2 752 078 | 10/1998 |
| GB | 1 571 219 | 7/1980 |
| GB | 2 061 490 | 5/1981 |
| GB | 2 203 582 | 10/1988 |
| GB | 2 254 419 | 10/1992 |
| GB | 2 333 632 | 7/1999 |
| IT | 94 A001040 | 12/1994 |
| WO | WO 91/17842 | 11/1991 |
| WO | WO 92/11953 | 7/1992 |
| WO | WO 95/28996 | 11/1995 |
| WO | WO 96/23281 | 8/1996 |
| WO | WO 96/34258 | 10/1996 |
| WO | WO 99/38126 | 7/1999 |
| WO | WO 99/60353 | 11/1999 |
| WO | WO 03/049045 | 6/2003 |
| WO | WO 03/103860 | 12/2003 |

* cited by examiner

CHIP SORTING AND STACKING DEVICES

CROSS-REFERENCE TO RELATED APPLICATIONS

This application is a divisional of U.S. patent application Ser. No. 11/004,006 filed Dec. 3, 2004, pending, which is a continuation of International Patent Application No. PCT/AT03/00149 filed May 26, 2003, and published as International Publication Number WO 03/103860A1 on Dec. 18, 2003, which in turn claims priority to Austrian Application No. 359/2002 filed Jun. 5, 2002, now Austrian Patent AT 006 405. The entire disclosure of each of the foregoing applications is incorporated herein by this reference. This application is also related to U.S. patent application Ser. No. 11/590,340, filed Oct. 30, 2006, pending, which is a continuation of U.S. patent application Ser. No. 11/004,006 filed Dec. 3, 2004, pending; to U.S. patent application Ser. No. 11/583,520, filed Oct. 19, 2006, pending; to U.S. patent application Ser. No. 60/444,178, filed Feb. 3, 2003; to U.S. patent application Ser. No. 10/742,722, filed Dec. 19, 2003, now U.S. Pat. No. 6,976,589, issued Dec. 20, 2005; to U.S. patent application Ser. No. 11/069,091, filed Mar. 1, 2005, now U.S. Pat. No. 7,028,826, issued Apr. 18, 2006; to U.S. patent application Ser. No. 11/069,426, filed Mar. 1, 2005, now U.S. Pat. No. 7,201,268, issued Apr. 10, 2007; to U.S. patent application Ser. No. 11/682,132, filed Mar. 5, 2007, now U.S. Pat. No. 7,681,708, issued Mar. 23, 2010; and to U.S. patent application Ser. No. 12/729,577, filed Mar. 23, 2010, pending.

TECHNICAL FIELD

The invention relates to a sorting device for gaming chips and counters, in particular, to gaming chips and counters of different colors and in accordance with the preamble of claim 1.

BACKGROUND

Sorting devices for gaming chips have been known for a long time. GB 2061490 discloses a device that distributes gaining chips that are collected by a transport chain and passed by a feature recognition system, from the chain into appropriate removal units. A disadvantage of this solution is the high space requirement for the chain. A further disadvantage is the high manufacturing costs, because the chain comprises many individual members, each of these members in addition being provided with a spring-loaded pin for distributing gaming chips.

GB 2254419 describes a device in which the gaming chips are first collected by a transport disc and then transferred to a chain, recognized there, and distributed to a removal unit. This arrangement requires less space than the aforementioned device. Nevertheless, it uses resilient elements to retain individual gaming chips, transferred from the transport disc to the chain, in the chain itself. These resilient elements precisely, however, accept only gaming chips with a largely uniform diameter, because gaming chips with a diameter greater than the nominal diameter can be transferred to the chain only at a high load or not at all; gaming chips with a diameter smaller than the nominal diameter cannot be reliably retained and fall out of the chains on the way to distribution to the removal units. The additional chain leads to additional manufacturing costs.

U.S. Pat. No. 6,381,294 discloses a chip-sorting device in which the conveyance of the chips is effected by a chain. This transport means is very expensive to maintain, however.

SUMMARY OF THE INVENTION

This invention avoids these disadvantages and proposes a sorting device of the aforementioned type, which has low manufacturing costs with a low space requirement and with which the gaming chips and counters may have highly different dimensions.

As taught by the invention, these advantages are achieved with a sorting unit of the aforementioned type by means of the characteristic features of some embodiments of the invention.

The proposed measures make it possible to convey and sort chips and counters of different dimensions by means of a cost-effective and simple transport device. The technically expensive and maintenance-intensive insertion of a chain conveyor is not necessary. The sorting device is robust to gaming chips and counters of different size. By the raising of the gaming chips by the ejector and the simultaneous rotation of the transport disc, the chips are automatically lifted out of the transport disc and organized in a removal unit.

Thereby, the features of some embodiments of the invention provide the advantage of a very gentle and careful distribution of the chips and counters into the removal units.

The features of additional embodiments of the invention assure that the distribution movement for a single gaming chip or counter is always constant relative to the movement of the transport disc, even when the transport speed changes.

The organization of the gaming chips and counters, in conjunction with the feature recognition system, can be easily programmed and controlled by means of the features of some embodiments of the invention.

Several removal units can be filled simultaneously by means of the features of additional embodiments of the invention.

A portion of the sorted gaming chips and counters can be removed from the removal units in a simple manner by means of the features of some embodiments of the invention.

The features of some embodiments of the invention can adjust the number of gaining chips and counters to be removed from the removal units.

To accomplish this, a tilting movement of the removal lever is provided according to some embodiments of the invention.

The removal lever is always proximate to the gaming chips and counters by means of the features of some embodiments of the invention.

By means of the features of some embodiments of the invention, it can be determined when a removal unit has been totally filled, whereupon gaming chips and counters can no longer be sorted into this removal unit.

The conveying speed of the gaming chips and counters in the system is adjusted by means of the characteristic features of some embodiments of the invention.

The characteristic features of some embodiments of the invention describe the preferably employed feature recognition system.

The base frame can be adjusted in height and adapted to the specific table heights by means of the characteristic features of some embodiments of the invention.

BRIEF DESCRIPTION OF THE SEVERAL VIEWS OF THE DRAWINGS

The invention will now be illustrated in greater detail by the drawings. Here.

DETAILED DESCRIPTION OF THE INVENTION

Figure 1:
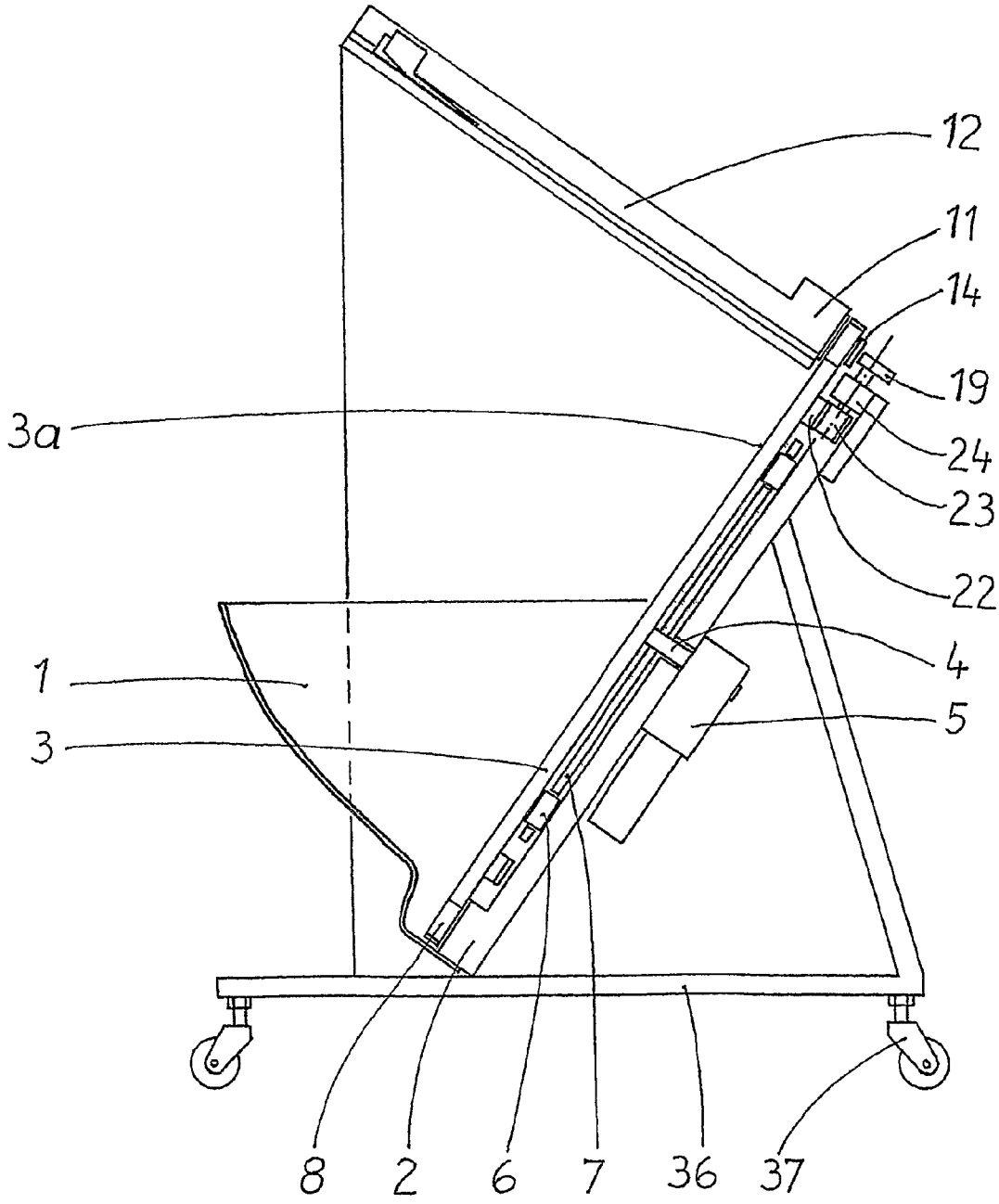
FIG. 1 shows a schematic drawing of a sorting unit of the invention without a housing.

The chip sorting and stacking device consists of an upwardly open collection container 1 for used gaming chips and counters, also called a "hopper," which is fixed to the sloping base plate 2.

A conveying device forms a circular disc 3, the "hopper disc," and is mounted drivably on shaft 4. The shaft 4 is supported by the base plate 2 and is connected to the drive 5.

The hopper disc 3 is supported axially by a plurality of rolling elements 6, which in turn are guided in cage plate 7. This axial support may be omitted, if the central support of the shaft 4 can absorb the axial forces and the hopper disc 3 is made suitably rigid.

Figure 5:
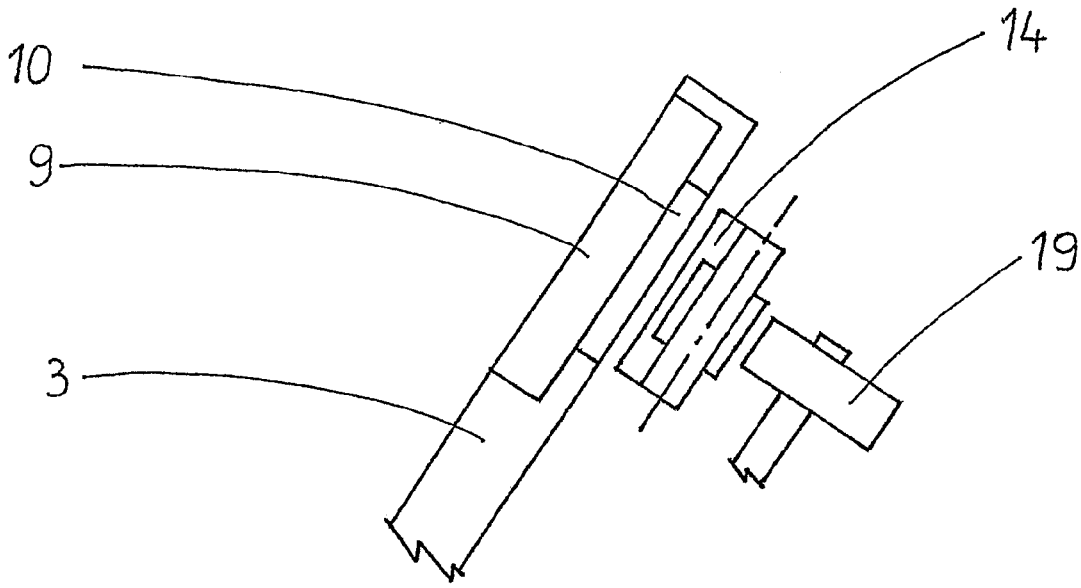
FIG. 5 shows an alternative depiction of the hopper disc.

In use, the gaming chips and counters 27 (FIG. 2) are collected in the hopper 1, where due to gravity they are taken up in the hopper disc 3 at the lowest point of the hopper 1 by circular recesses 8, arranged around the perimeter of the hopper disc 3. The circular recesses 8 have at least the diameter of the largest circular chip or counter that is to be processed. The depth of the recesses 8 in the embodiment results from the thickness of the hopper disc 3 and constitutes at least the thickness of the thickest counter. During the use of circular recesses 8 according to FIG. 1, the gaming chips and counters 27 slide on the base plate 2 during the rotation of the hopper disc 3. FIG. 5 shows an alternative collection of chips and counters in blind holes 9. These are open toward the side of the hopper 1 and closed toward the side of the base plate 2. Thereby, the back of the hopper disc 3 must have an annular circumferential groove 10, which substantially has the width of the ejector 14 of FIG. 3.

The hopper disc 3 conveys the gaming chips and counters 27, taken up in any order by the recesses 8, upwards at an angle of approximately 135°, whereby they are passed before a color sensor, which differentiates the chips and counters based on their color combination and size. Depending on chip color and pattern, the sensor conveys a signal to the microprocessor control (not shown) of the chip sorting and stacking device. This microprocessor control decides, based on a freely programmable assignment of colors, to which of the removal units 12 each of the conveyed gaming chips and counters 27 is distributed.

Alternatively, recognition of the gaming chips and counters 27 can occur by means of a spectrometer in a feature recognition system, which for differentiation detects the wavelengths of the color codes undetectable by the human eye. To accomplish this, the gaming chips and counters 27 must be provided with such color codes.

After recognition, the gaming chips and counters 27 are distributed into the removal units 12. This area extends at about 90° to the hopper disc 3.

Figure 4:
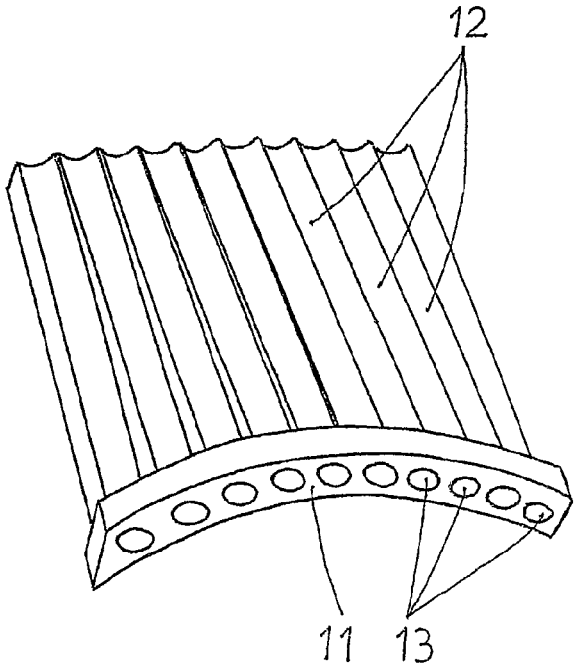
FIG. 4 shows a possible spatial form of the removal units.

FIG. 4 shows the transfer element 11, which is designed substantially as an arc-like sector and has a number of apertures 13, in which the different gaming chips and counters 27, sorted cleanly per aperture 13, are distributed from the hopper disc 3 (FIG. 1) into removal units 12. Ten apertures are used in the exemplary embodiment.

Figure 2:
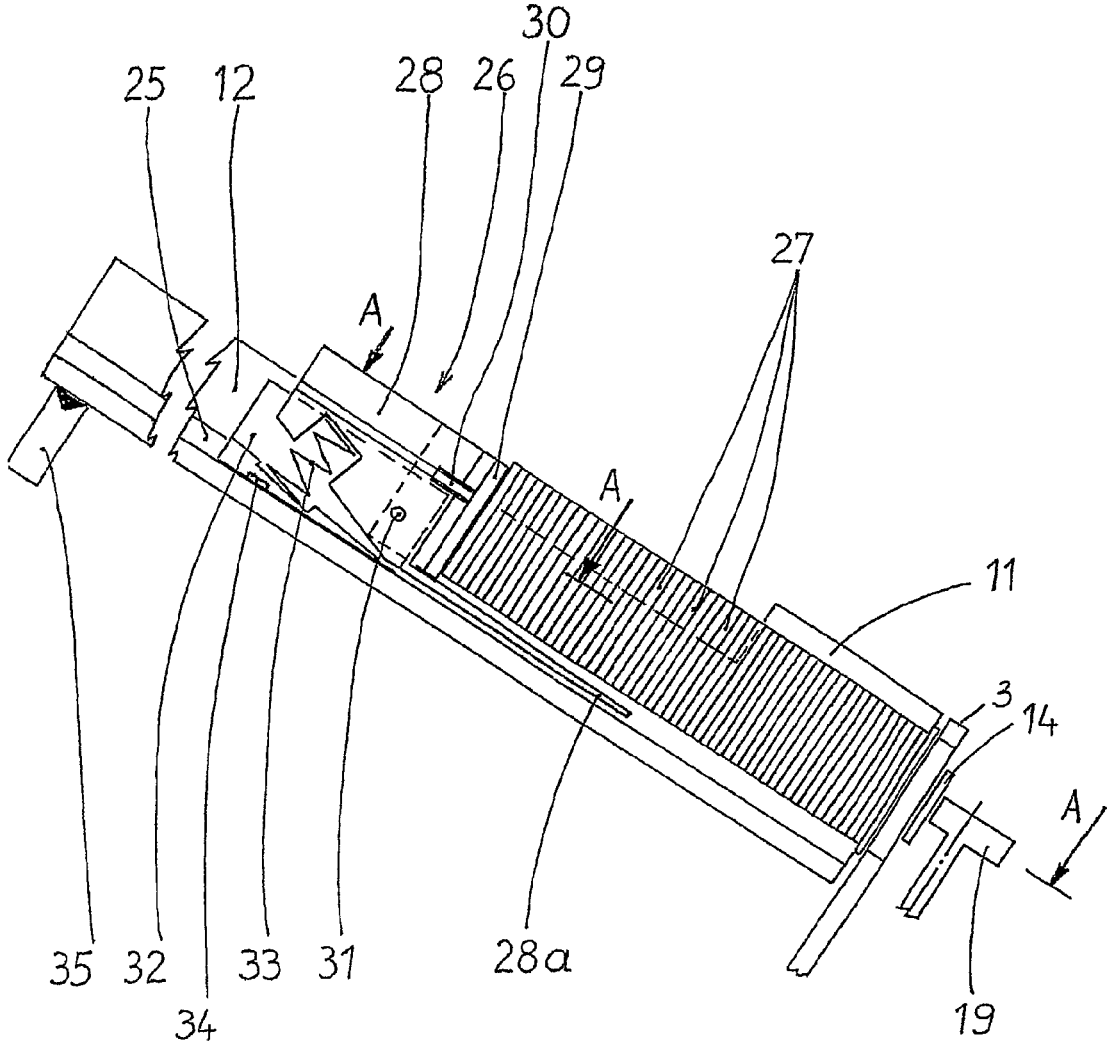
FIG. 2 shows a cross-section through a removal unit.
Figure 3:
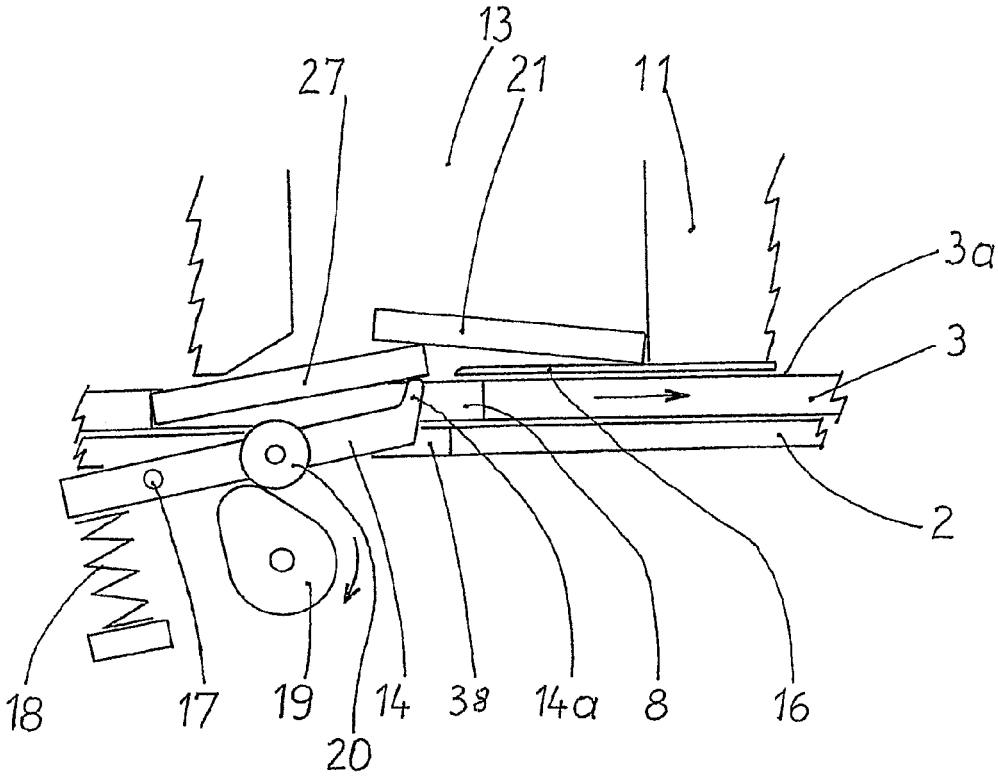
FIG. 3 shows a section through a chip and counter distribution unit along line AA of FIG. 2.

The actual distribution of gaming chips and counters 27 is readily evident from FIG. 3, which shows a section along the line AA of FIG. 2 through one of the apertures 13 in the transfer element 11. Each of the apertures 13 is assigned an ejector 14, which after activation is inserted into the recesses 8 through a slit 38 in the base plate 2 and raises the corresponding gaming chip or counter 27 above the face 3*a* of hopper disc 3 during the movement of the hopper disc 3. The ejector 14 is mounted so that it swivels around the shaft 17 and is pushed against the cam 19 via spring 18 causing contact of gaming chip or counter 27 by arm 14*a*. To enable a wear-free rolling of the cam 19 on the ejector 14, the ejector 14 can be provided expediently with a roller 20.

By means of the continuous movement of the hopper disc 3, the gaming chip or counter 27 is pushed over the blade 16, where it finally rests. If another counter 21 is located on the blade 16, it is unavoidably raised by means of the lifting motion of the gaming chip or counter 27, 50 that gaming chip or counter 27 comes to lie finally under counter 21. This process is repeated as long as gaming chips or counters 27 of the same type are being conveyed, so that the removal units 12 fill with gaming chips or counters 27.

FIG. 4 shows the removal units 12 directly adjacent to the transfer element 11, the removal units 12 that run next to one another expediently from the arc-like arrangement in the area of the transfer element 11 to a straight or nearly straight arrangement to facilitate the easy removal from all sides of gaming chips or counters 27 (FIG. 2) deposited herein.

FIG. 1 shows the drive of the cam 19. On the side, facing away from hopper 1, of the hopper disc 3, there is an annular ring gear 22 that drives the pinion 23 associated with a cam 19. The microprocessor control of the chip sorting and stacking device actuates a magnetic coupling 24, associated with the cam 19, and thereby creates the connection between the pinion 23 and the cam 19 for a cam rotation. This assures that the ejector 14 always performs the same movement relative to the hopper disc 3, independently of the conveying speed of hopper disc 3.

If a jam were to occur during the transfer of the gaming chips and counters 27 into the removal units 12, a short return motion of the hopper disc 3 is provided. To recognize a jam, the current of the drive 5 can be monitored, or the movement of the hopper disc 3 can be queried directly via a suitable sensor.

To increase the conveying performance and simultaneous reduction of wear on all moving parts of the chip sorting and stacking device, adjustment of the conveying speed of the chip sorting and stacking device to the quantity of counters to be sorted in each case is recommended. The speed can be set depending on whether and how many free recesses 8, i.e., not filled with gaming chips or counters 27, in the hopper disc 3 can be detected by the counter recognition system.

The removal units 12 for sorted gaming chips and counters 27 can be seen in FIG. 2 and consist substantially of upwardly open chip transporters, each respectively provided with a central groove 25. For the expedient removal of gaming chips and counters 27 from the removal units 12, a special device is provided, such as a "cutter" 26, which glides downward in one of the grooves 25 by means of gravity and thus constantly abuts the reserve gaming chips and counters 27 in the removal units 12. The cutter has an L-shaped lever 28, the thin arm 28*a* of which lies underneath the gaming chips and counters 27. At the same time, a stop 29 always abuts the gaming chips and counters 27 and in turn is supported by lever 28 via an adjusting screw 30. The lever 28 and stop 29 are connected in a swiveling manner by means of the shaft 31 with the body 32 gliding within the groove 25. Through pressure applied in the direction of arrow A, a predetermined quantity, preferably 20 pieces, of gaming chips or counters 27 can be raised by the lower arm 28*a* of the L-shaped lever 28 and are thus freely removable from the total quantity of gaming chips or counters 27.

The quantity of gaming chips and counters that can be lifted by the cutter 26 can be finely adjusted or matched to the precise thickness of the gaming chips and counters 27 via the adjusting screw 30.

The use of a pressure spring 33 assures that lower arm 28*a* of the L-shaped lever 28 always remains underneath the counters, but this is not absolutely required.

In order to prevent the distribution of more gaming chips or counters into one of the removal units 12 than can be accommodated by its stack length, every removal unit 12 is provided with a sensor 35. As soon as the cutter 26 reaches its endpoint, the sensor 35 sends a signal to the microprocessor control, which then no longer ejects gaming chips and counters 27 into the particular channel. The sensor 35 can, for example, be either an optical or magnetic sensor. To that end, a permanent magnet 34 must be provided in the bottom of the cutter 26.

The chip sorting and stacking device can be designed adjustable with simple means to different table or operator heights. As is evident from FIG. 1, the casters 37 are attached to the base frame 36 to be adjustable in height.

What is claimed is:

1. A chip sorting and stacking device, comprising:

a disc rotatable about an axis and comprising a plurality of chip receiving wells proximate an outer edge of the disc;

a plurality of channels each configured to hold a stack of chips;

at least one ejector for ejecting chips from the chip receiving wells of the disc into a channel of the plurality of channels; and at least one removal lever associated with at least one channel of the plurality of channels, the at least one removal lever having an elongated pivot arm configured to extend adjacent at least a portion of a stack of chips when the stack of chips is held within the at least one channel of the plurality of channels;

wherein the at least one removal lever is mounted to a body configured to slide within a groove associated with the at least one channel of the plurality of channels.

2. The device of claim 1, further comprising an adjustment device configured to adjust a number of chips in the stack of chips that may be displaced upon causing the pivot arm to pivot against the at least a portion of the stack of chips.

3. The device of claim 2, wherein the adjustment device comprises an adjustable screw.

4. The device of claim 1, further comprising a sensor configured to detect when the stack of chips comprises a predetermined number of chips.

5. The device of claim 4, further comprising a microprocessor configured to prevent the at least one ejector from ejecting additional chips into the stack of chips when the sensor detects that the stack of chips comprises the predetermined number of chips.

6. The device of claim 1, further comprising a spring member configured to bias the at least one removal lever in a position relative to the stack of chips when the stack of chips is held within the at least one channel of the plurality of channels.

7. A chip sorting and stacking device, comprising:

a disc rotatable about an axis and comprising a plurality of chip receiving wells proximate an outer edge of the disc;

a plurality of channels each configured to hold a stack of chips;

at least one ejector for ejecting chips from the chip receiving wells of the disc into a channel of the plurality of channels; and at least one spring member located to bias the at least one ejector against a rotatable non-circular cam member positioned to cause the at least one ejector to move between a retracted position and an extended position responsive to rotation of the cam member.

8. The device of claim 7, wherein the at least one ejector is biased to the retracted position in which the at least one ejector is retracted from the disc.

9. The device of claim 7, wherein the at least one ejector is configured to eject chips from the plurality of chip receiving wells of the disc directly into the channel of the plurality of channels.

10. The device of claim 7, wherein rotation of the disc causes rotation of the rotatable non-circular cam member when the at least one ejector is actuated.

11. The device of claim 7, further comprising a roller mounted to the at least one ejector, the roller configured to roll over a surface of the rotatable non-circular cam member as the rotatable non-circular cam member is rotated.

12. The device of claim 7, further comprising a gaming chip characteristic identification system positioned adjacent the disc.

13. The device of claim 10, further comprising:

a gear associated with the disc; and a pinion associated with the rotatable non-circular cam member, the pinion engaged with the gear when the at least one ejector is actuated and disengaged with the gear when the at least one ejector is not actuated.

* * * * *

UNITED STATES PATENT AND TRADEMARK OFFICE

CERTIFICATE OF CORRECTION

PATENT NO. : 7,861,868 B2
APPLICATION NO. : 11/932691
DATED : January 4, 2011
INVENTOR(S) : Ernst Blaha and Peter Krenn It is certified that error appears in the above-identified patent and that said Letters Patent is hereby corrected as shown below:

On the title page:

In ITEM (75) Inventors: change "Tullnerback" to --Tullnerbach--

In the specification:

| | | |
|---|---|---|
| COLUMN 1, | LINE 42, | change "gaining chips" to --gaming chips-- |
| COLUMN 2, | LINE 38, | change "gaining chips" to --gaming chips-- |
| COLUMN 3, | LINES 11,12, | change "the sloping base plate" to --a base plate-- |
| COLUMN 3, | LINE 58, | change "the transfer" to --a transfer-- |
| COLUMN 4, | LINE 5, | change "the shaft" to --a shaft-- |
| COLUMN 4, | LINE 6, | change "the cam" to --a cam-- |
| COLUMN 4, | LINE 11, | change "the blade" to --a blade-- |
| COLUMN 4, | LINE 15, | change "counter **27**, **50** that" to --counter **27**, so that-- |
| COLUMN 4, | LINE 26, | change "the drive of" to --the drive **5** of-- |
| COLUMN 4, | LINE 28, | change "the pinion" to --a pinion-- |
| COLUMN 4, | LINE 28, | change "a cam" to --the cam-- |
| COLUMN 4, | LINE 59, | change "The cutter has" to --The cutter **26** has-- |
| COLUMN 5, | LINE 12, | change "counters into" to --counters **27** into-- |

In the claims:

| | | | |
|---|---|---|---|
| CLAIM 2, | COLUMN 5, | LINE 44, | change "the pivot" to --the elongated pivot-- |
| CLAIM 7, | COLUMN 6, | LINE 16, | change "the chip" to --the plurality of chip-- |
| CLAIM 7, | COLUMN 6, | LINE 24, | change "the cam" to --the rotatable non-circular cam-- |

Signed and Sealed this
Twenty-seventh Day of December, 2011

David J. Kappos

David J. Kappos
*Director of the United States Patent and Trademark Office*